US009100753B2

(12) United States Patent
Adelman

(10) Patent No.: US 9,100,753 B2
(45) **Date of Patent: *Aug. 4, 2015**

(54) ACOUSTIC TRANSDUCER

(71) Applicant: Roger A. Adelman, Villa Hills, KY (US)

(72) Inventor: Roger A. Adelman, Villa Hills, KY (US)

( * ) Notice: Subject to any disclaimer, the term of this patent is extended or adjusted under 35 U.S.C. 154(b) by 54 days.

This patent is subject to a terminal disclaimer.

(21) Appl. No.: 13/867,895

(22) Filed: Apr. 22, 2013

(65) Prior Publication Data

US 2014/0146995 A1 May 29, 2014

Related U.S. Application Data

(63) Continuation-in-part of application No. 12/714,083, filed on Feb. 26, 2010, now Pat. No. 8,428,297.

(60) Provisional application No. 61/156,275, filed on Feb. 27, 2009.

(51) Int. Cl.

| | |
|---|---|
| ***H04R 1/00*** | (2006.01) |
| ***H04R 11/02*** | (2006.01) |
| ***H04R 1/10*** | (2006.01) |
| ***H04R 25/00*** | (2006.01) |
| ***H04R 9/02*** | (2006.01) |
| *H04R 7/04* | (2006.01) |
| *H04R 11/00* | (2006.01) |

(52) U.S. Cl.
CPC ..... *H04R 11/02* (2013.01); *H04R 1/10* (2013.01); *H04R 9/025* (2013.01); *H04R 25/00* (2013.01); *H04R 7/04* (2013.01); *H04R 11/00* (2013.01)

(58) Field of Classification Search
USPC ..... 381/431, 412, 414, 419, 421
See application file for complete search history.

(56) References Cited

U.S. PATENT DOCUMENTS 7,558,395 B2 * 7/2009 De Haan ..... 381/338

* cited by examiner

*Primary Examiner* — Davetta W Goins
*Assistant Examiner* — Amir Etesam
(74) *Attorney, Agent, or Firm* — Porter Wright Morris & Arthur, LLP

(57) ABSTRACT

An acoustic transducer includes a sound-producing member at least partially disposed within the first magnetic flux gap region between the magnetic poles. The sound-producing assemblage is magnetically excited through a magnetic circuit that passes from a location outside the magnetic flux gap region to inside the magnetic flux region through an air gap. The moving member is controllably movable under the influence of at least one varying magnetic field, and its movement is constrained by a unique combination of mechanical restraints and magnetic restraints imposed upon the moving member by the interaction of a plurality of magnetic fields.

51 Claims, 6 Drawing Sheets

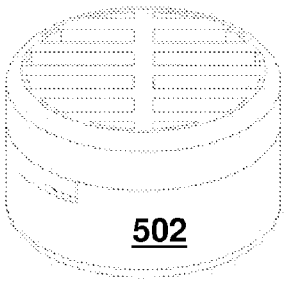
Fig.4a
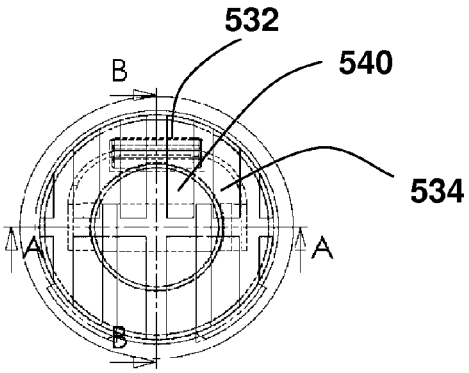
Fig.4b
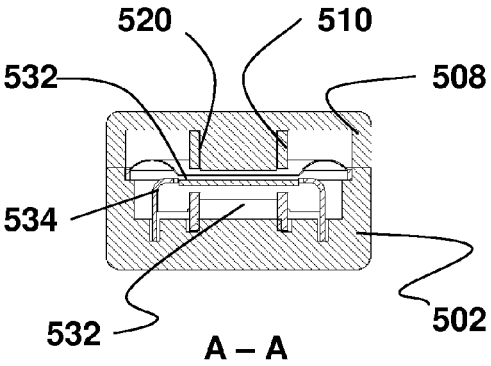
Fig.4c
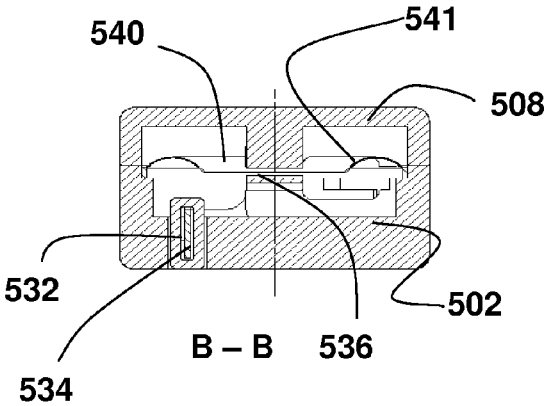
Fig.4d
Fig.4

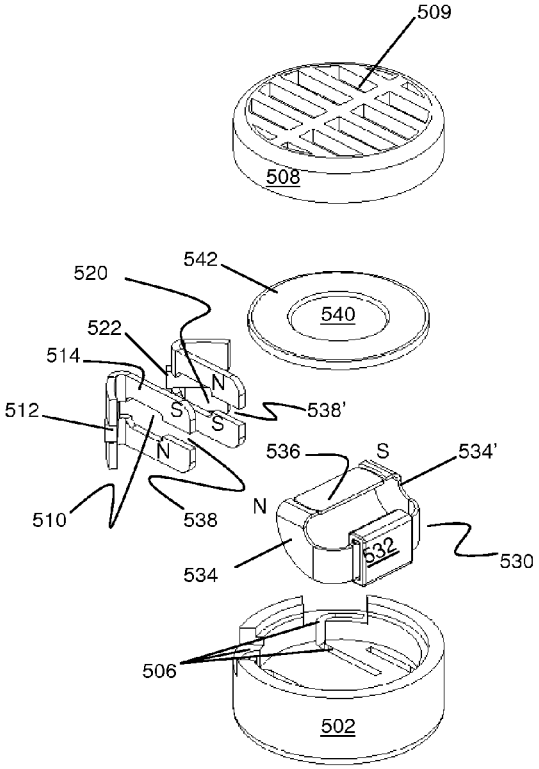
Fig. 5a
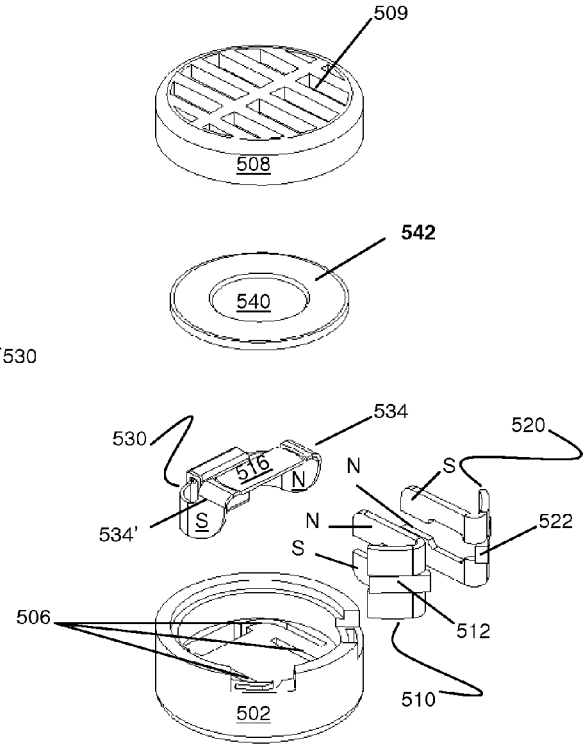
Fig. 5b
Fig. 5

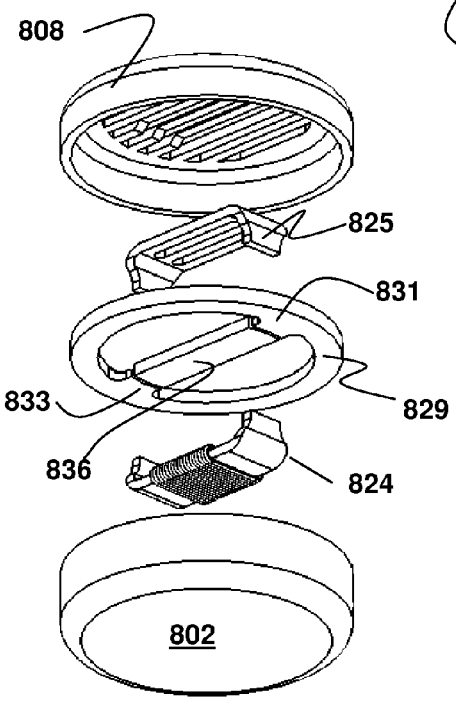
Fig. 8b
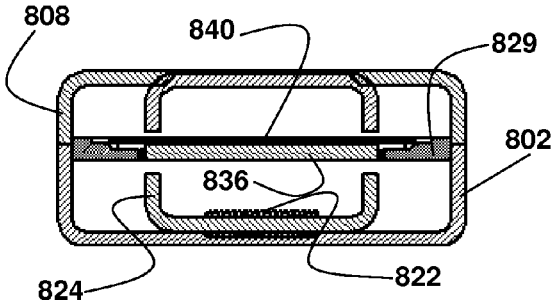
Fig. 8d
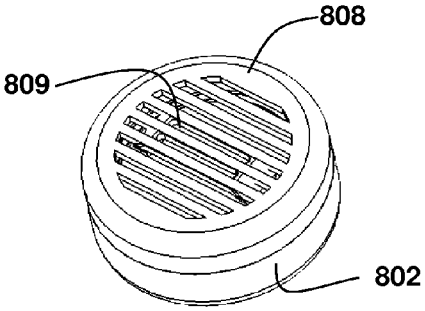
Fig. 8a
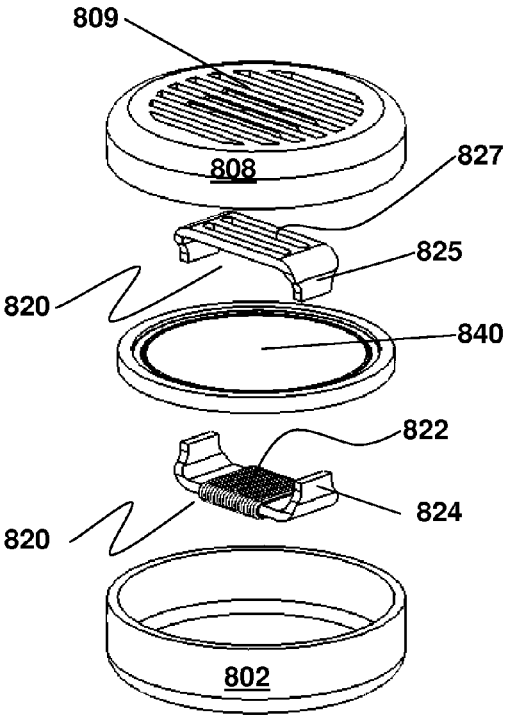
Fig. 8c
Fig. 8

ACOUSTIC TRANSDUCER

RELATED APPLICATIONS

This application is a continuation-in-part of U.S. patent application Ser. No. 12/714,083, filed Feb. 26, 2010, now U.S. Pat. No. 8,428,297, and claims priority thereto under 35 U.S.C. §120. U.S. patent application Ser. No. 12/714,083 claims priority under 35 U.S.C. §119 (e) to U.S. Provisional Application Ser. No. 61/156,275 filed Feb. 27, 2009, to which this application further claims priority.

FIELD OF THE INVENTION

The present invention generally relates to the field of electro-magnetic transducers and will be disclosed in connection with a transducer utilizing a moving member that forms part of a magnetic circuit, but which is mechanically decoupled from the remaining circuit components. While the invention has applicability to a wide range of diverse applications, and can be employed in any number applications where it is desired to produce a mechanical output from electrical energy, for simplicity of explanation, it be specifically disclosed in an application where the mechanical output is used to move a fluid, as for example in a speaker for producing air-borne sound waves.

BACKGROUND

Miniature electro acoustic transducers have long been fundamental components of communications equipment ranging from telephones to hearing aids and most recently to personal listening devices such as MP3 players. In general there are two technologies available for producing such speakers, which technologies are generally referred to in the industry by the terminology "balanced armature" and "moving coil." Conventional balanced armature technology uses two magnetic fields, one static and another responsive to a signal to produce force that moves a sound generating surface. Moving coil technology employs a single, static radially disposed, magnetic field through which a coil resides in an air gap in the radial field. When current flows through the coil in response to an electrical signal carried it the coil, a force is generated perpendicular to the plane of both the radial magnetic flux and the path of the wire coiling through the air gap. Each technology finds usefulness in particular applications. For example, in the context of audio speakers, the moving coil technology generally dominating usage with respect to larger speakers. As a moving coil speaker is reduced in size, however, the central magnetic pole residing on the shorter radius of the air gap becomes smaller and smaller, and it finally reaches a dimension where it can no longer effectively carry sufficient magnetic flux for an operable speaker. Thus, as a practical matter, moving coil speakers are seldom produced having diameters smaller than about 8 mm. On the other hand, again in the context of audio speakers, the balanced armature technology finds its greatest use in extremely small speakers such as those used for hearing aids within the listener's ear canal. The balanced armature technology has size limitations as it grows larger, because the total excursion of the sound generating surface must be within the limits of the air gap between the static poles. As a practical matter, balanced armature technologies are seldom produced having major dimensions exceeding 10 mm.

A further limitation to the performance of conventional balanced armature electro acoustic devices, (whether used as speakers or microphones) is that their frequency spectra deviate from being perfectly flat, spectral flatness being one representation of a lack of distortion, a very desirable characteristic for acoustic (and most other) transducers. This spectral deviation or "signature" arises from the fundamental structural properties that are characteristic of all conventional balanced armature devices: the mass and springiness of: the armature itself, the sound producing diaphragm and its chamber(s), and, in most conventional speaker of this type, of the connector element and its attachments that link the armature and the diaphragm. Numerous techniques have been developed to minimize the disadvantages of this inherent signature, including, for example, the use of so-called "ferro-fluids" for damping the system and improving the transducer's dynamic performance.

Notwithstanding the substantial enhancements to these general types of transducers, room remains for improving and simplifying the frequency signature, minimizing the frictional and other mechanical losses, and improving the efficiency of this type of speakers. In many applications, it also is desirable to further reduce the size of the transducer. For example, when used in a hearing aid or earphone application, it is desirable to have a transducer that is small enough to comfortably fit within a human auditory canal. Similarly, when used as a component of a device, such as a cell phone, the small size of the transducer allows the size of the device to be minimized.

BRIEF DESCRIPTION OF THE DRAWINGS

The accompanying drawings incorporated in and forming a part of the specification illustrate several aspects of the present invention, and together with the description, serve to explain the principles of the invention. In the drawings:

FIG. 4*a* is a perspective view showing the external surfaces of an acoustic speaker employing a transducer constructed in accordance with one exemplary embodiment of the present invention;

FIG. 4*b* is a plan view of the acoustic speaker housing shown in FIG. 4*a*, showing, in phantom liles, the positional relationships of selective portions of an exemplary transducer illustrated in FIG. 5;

FIG. 4*c* is a cross-sectional view taken across cutting plane A-A in FIG. 4*b;*

FIG. 4*d* is a cross-sectional view taken across cutting plane B-B in FIG. 4*b;*

FIG. 5*a* is an exploded view of the transducer and housing of FIG. 4;

FIG. 5*b* is a further exploded view of the transducer and housing of FIG. 4 taken from a different viewing angle:

FIG. 8*a* is a perspective view of an alternative example of a transducer configured in accordance with the present invention; and FIG. 8*b* is an exploded view of the transducer shown in FIG. 8*a* showing its internal components;

FIG. 8*c* is an exploded view showing the transducer of FIGS. 8 and 8*b* from a different viewing angle; and FIG. 8*d* is a front elevational cross-sectional view of the transducer of FIG. 8*a*.

Figure 1:
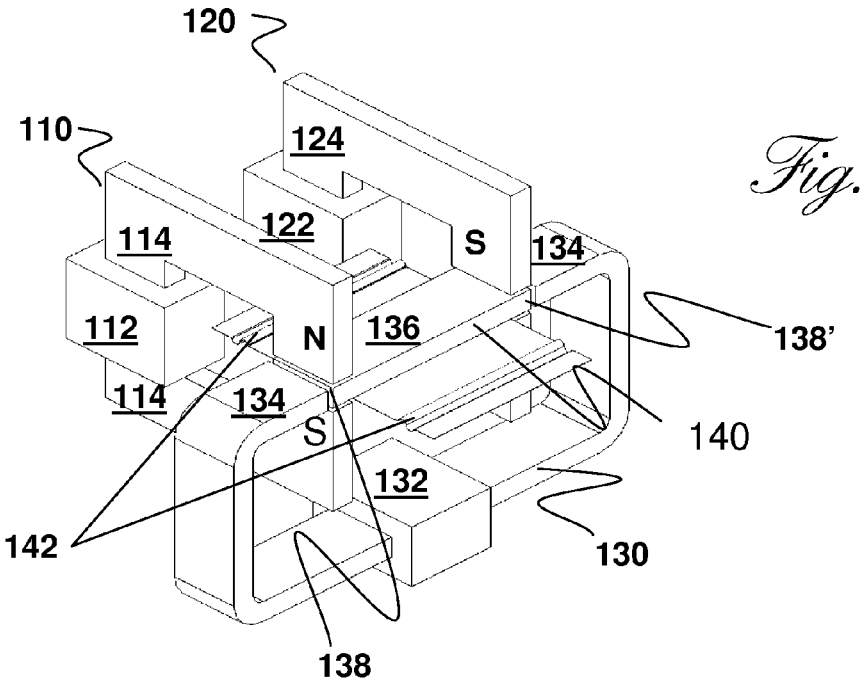
FIG. 1 is a schematic illustration depicting one configuration of a moving member in a transducer that forms a part of a magnetic circuit, but that is structurally decoupled from the physical restraints of the remaining portions of the circuit.

Reference will be made in detail to certain exemplary embodiments of the invention, examples of which are illustrated in the accompanying drawings.

BRIEF SUMMARY

In one example of the invention, an electro-magnetic transducer includes a housing that supports a plurality of magnetic circuits. One or more of the plurality of magnetic circuits forms end surfaces at predetermined spaced locations within the housing. The end surfaces or the one or more magnetic circuits are operative to emanate magnetic flux densities of equal and opposite polarities at the predetermined spaced locations. A further magnetic circuit is structurally configured so that components of the further magnetic circuit terminate with their respective ends facing one another across a predetermined expanse with a movable dipole of magnetically permeable material residing in the predetermined expanse. The dipole has its opposite longitudinal ends in spaced relationship to the respective facing ends of the circuit components so as to form two gaps, one at each end of the dipole. The dipole is configured and positioned so that its opposite ends reside in proximity to the predetermined spaced locations in magnetic flux of equal and opposite polarities emanating at the end surfaces of the one or more magnetic surfaces. A non-magnetic permeable support member is affixed to and supports the dipole. The support member provides selective positional compliance so that its support of the dipole is compliant in the direction generally perpendicular to the plane of the support surface and generally non-compliant within such plane. At least one of the plurality of magnetic circuits is non-static and operative to vary the magnetic flux in the proximity of the predetermined spaces. The dipole is operative to move under the influence of the interaction of the magnetic fluxes at the predetermined spaced locations in response to changes in the magnetic flux created by at least one of the magnetic circuits.

According to another example, the housing functions to support the plurality of magnetic circuits in a predetermined spatial relationship to each other.

According to another example, the housing supports the compliant support member affixed to the dipole in a plane that is normal to the primary direction of the magnetic flux emanating from the end surfaces.

In another aspect of the invention, the housing retains the non-magnetically permeable support member in a predefined spatial relationship to the magnetic flux emanating from the end surfaces.

In another exemplary aspect, the non-magnetically permeable support member is a diaphragm.

In another example, the housing supports the diaphragm at the diaphragm's peripheral surface.

In another specific implementation, the diaphragm has a circular configuration, and the housing supports the diaphragm around the circular peripheral surface of the diaphragm.

In another example of the invention, the opposite longitudinal ends of the dipole are positioned in high density portion of magnetic flux emanating from the end surfaces of one or more of the plurality of magnetic circuits.

In a further example, the end surfaces of the one or more of the plurality of magnetic circuits are configured to focus the magnetic flux density at opposite longitudinal ends of the dipole.

In another example, the positional compliance provided by the non-magnetically permeable support member in the direction generally perpendicular to the plane of the support surface is nonlinear.

In a still further example, the positional compliance provided by the support member in a direction generally perpendicular to the plane of the support surface is inversely proportional to magnetic strength of the magnetic poles.

In another example, the one or more of the plurality of magnetic forming the end surfaces is a rigid structure.

In another example, the one or more of the plurality of magnetic circuits includes at least two magnetic circuits that are rigid structures in generally parallel relationship to each other, and the rigid structures of each circuit are configured to approach each other as they approach the end surfaces.

In one example of the invention, the magnetically permeable material is formed from a rare earth metal.

In another example, the magnetically permeable material is formed of a ferromagnetic material.

In one example, at least one of the plurality of magnetic circuits is a static magnetic circuit.

In another example, at least one of the plurality of magnetic circuits includes a permanent magnet.

In another example, the one or more of the plurality magnetic includes at least one static magnetic source and at least one dynamic magnetic source.

In another example, the non-magnetic support member includes a compliance enhancing feature on its periphery.

In one specific form of the invention, the electro-magnetic transducer is configured as an acoustic speaker.

In another example, at least one of the plurality of magnetic circuits is dynamically responsive to an external AC signal.

In a further example of the invention, an electro-magnetic transducer includes a housing, a first magnetic circuit that includes a magnetic dipole that between first and second longitudinally spaced magnetic poles, and one or more magnetic circuit components that are formed of magnetically permeable material. The one or more magnetic circuit components has first and second ends that are located in predetermined longitudinally spaced proximity to the first and second magnetic poles of the dipole respectively, and are separated from the first and second magnetic poles of the magnetic dipole by fluid gaps. The one or more magnetic circuit components is magnetically connected to the magnetic dipole across the fluid gaps. The dipole and the at least one or more magnetic circuit components provide a contiguous magnetic pathway. A support surface supports the dipole with respect to the housing with the magnetic dipole being affixed to the support surface. The support surface and the attached magnetic dipole are controllably movable through a limited range of movement in a first direction that is substantially perpendicular to the support surface. The support surface is further operative to restrain movement of the magnetic dipole in the other two directions orthogonal to said first direction and to each other. One or more further magnetic circuits are provided between first and second areas in proximity to the respective first and second magnetic poles of the magnetic dipole. These magnetic circuits interact with the magnetic dipole. The one or more further magnetic circuits has first and second end surfaces that are respectively located in respective first and second areas in predetermined spaced proximity to the first and second magnetic poles of the magnetic dipole and separated from the respective first and second magnetic poles by predetermined fluid gaps. The one or more further magnetic circuits are magnetically connectable to the magnetic dipole by magnetic flux that traverses the predetermined fluid gaps separating the magnetic dipole and the one or more further magnetic circuit components. At least one magnetic source is provided for applying a varying magnetic flux in the area occupied by the magnetic poles of the magnetic dipole. The varying magnetic flux is operative to move the support member and affixed magnetic dipole back and forth through the limited range of movement in the first direction.

In another exemplary form of the invention, opposite ends of the armature are positioned in high density portion of magnetic flux in the gaps between the outward end portions of the respective pairs of magnetically permeable structures of the first and second magnetic circuits.

In another exemplary form of the invention, the outward end portions of the respective pairs of magnetically permeable structures are configured to focus the magnetic flux density in the gaps.

In another exemplary form of the invention, the outward end portions of the respective pairs of magnetically permeable structures are configured to produce a predetermined magnetic flux field.

In another exemplary form of the invention, positional compliance is provided by the non-magnetically permeable support member in a direction normal to the primary direction of the magnetic flux is nonlinear.

In another exemplary form of the invention, the positional compliance provided by the support member in a direction normal to the primary direction of the magnetic flux field is inversely proportional to magnetic strength of the magnetic poles.

In another exemplary form, each pair of magnetically permeable structures includes a pair of rigid structures.

Another exemplary form of the invention the rigid structures in parallel relationships to each other, and are configured to approach each other as they approach their outward end portions proximal to their respective gaps.

In another exemplary form of the invention, each magnetically permeable structures in each pair of structures each form a magnetic path from a magnetic source to a gap.

BRIEF EXPLANATION OF EXEMPLARY EMBODIMENTS

Turning now to the drawings, FIG. 1 shows, in simplified schematic form, an example of a transducer constructed in accordance with the principles of the present invention. The depicted transducer in this example includes three magnetic circuits, 110, 120, and 130, and a non-magnetic, and selectively compliant membrane support structure 140, which support structure is specifically depicted as a diaphragm in the simplified illustration of FIG. 1. The first magnetic circuit 110 includes a magnetic source 112 which is shown in the particular example as being positioned intermediate upper and lower (as shown the specific orientation depicted in FIG. 1, it being understood that the neither the invention nor the specific embodiment illustrated are limited to an orientation depicted in those drawings) permeable ferromagnetic conductive structures 114 which upper and lower structures jointly terminate across a predetermined gap 138 between the upper and lower portions of structure 114 at a location between end sections N and S (representing poles of opposite polarity). As shown, the structure 114 has a "C" shaped configuration with planar end surfaces of the respective portions N and S being in face-to-face relationship.

The second magnetic structure 120 is similarly configured and, as illustrated, is located in generally parallel spaced relationship to the first magnetic circuit 110. The second magnetic circuit 120 has a magnetic source 122, also illustrated in the specific embodiment depicted in FIG. 1 as being located intermediate upper and lower portions of a permeable ferromagnetic conductive structure 124. In the view of FIG. 1, the lower structure 124 is partially obstructed. The upper and lower portions 124 terminate across a predetermined gap 138' at a location between magnetic poles S and the N (the pole N is not visible from the viewing angle of FIG. 1). The positional relationships between the "S" of the first magnetic circuit 110 and the "S" of the second magnetic circuit 120 denotes that the magnetic fluxes in the two circuits 110 and 120 are equal and opposite across their respective predetermined termination gaps 138 and 138'.

The third magnetic circuit 130 includes a magnetic source 132 associated with a ferromagnetic conductive structure 134, the opposite ends of which terminate in planer face-to-face relationship across a predetermined expanse in which a moving member or dipole 136 is disposed. In the transducer example illustrated, the dipole 136 functions as an armature. The dipole or armature 136 specifically illustrated in FIG. 1 is physically configured into a parallelepiped shape, with a geometric length which extends between first and second longitudinally spaced ends of the magnetic permeable material forming dipole 136. The respective longitudinally spaced ends of the dipole 136 are separated from opposite ends of the structure 134 by gaps 138 and 138' at opposite ends of the dipole 136. In the embodiment illustrated, fluid occupies the space defined by the gaps 138, 138' between the end surfaces of the dipole or armature 136 and the end surfaces on the ferromagnetic conductive structure 134. The opposing end surfaces of the ferromagnetic conductive structure 134 and dipole 136 preferably are oriented in a planar face-to-face arrangement.

In the specific parallelepiped configuration shown in FIG. 1, the distance between the above-described end surfaces of the ferromagnetic conductive structure 136 (i.e., the surfaces adjacent gaps 138 and 138' respectively) is greater than the distance between opposite end surfaces of the structure in any other direction. Thus, the geometric longitudinal direction of the dipole 136 extends between the end surfaces of the dipole 136 that are in face-to-face relationship with the end surfaces of the ferromagnetic conductive structure 134. As will be apparent from the description below, the opposite longitudinal ends of the dipole with have opposite polarity in operation, and the principal direction of magnetic flux flow in the dipole 136 corresponds to the longest geometric direction. Thus, regardless as to whether the longitudinal direction is defined in terms of geometry or in terms of the principal direction of magnetic flux flow, the longitudinal direction is the same. Other configurations of the dipole or armature 136 may exist, however, in which the principal direction of magnetic flow differs from the longest geometric dimension. For purposes of clarity of explanation, however, as used in the present specification and claims, the term longitudinal will be used in connection with the description of any dipole to refer to the principal direction of magnetic flow, i.e., the direction between the opposite magnetic poles of the dipole at the respective ends of the structure.

The dipole or armature 136 is affixed to and supported by the flexible membrane compliant support structure 140, which as explained above, is depicted in this illustration as a diaphragm which provides a compliance which is non-linear as movement toward and away from the magnetic poles of circuits 110 and 120 as the distance from the poles is increased and decreased. It will be appreciated, however, that, depending upon the application, the support surface many not be a membrane that separates fluid on opposite sides. Regardless as to whether or not it is a diaphragm, it is helpful in many applications for the support structure or diaphragm 140 to be a directionally compliant mechanical member, that is, a member that permits limited movement in a first direction between the respective poles N and S of magnetic circuits 110 and 120, but constrains movement in the other two orthogonal directions.

The diaphragm 140 includes a surround 142 about its periphery to enhance movement in the first direction. As those skilled in the art will readily appreciate, the spatially fixed portions of the first magnetic circuit 110, second magnetic circuit 120, and third magnetic structure 130 as well as the portions of armature support structure 140 which are distal to the (non-stationary) armature location are affixed to a common housing support in the illustrated example. This housing support has been removed from the depiction of FIG. 1, however, for clarity of illustration of the depicted components.

The magnetic sources 112 and 122 may be either permanent magnets or electromagnets. In any event, for purposes of initial explanation, it will be assumed that these magnets create static magnetic fields that flow through one side of magnetic structures 114 and 124 across the predetermined air gaps form by the separated N and S poles, and back to the magnetic sources 112 and 122 through the opposite legs of the respective magnetic structures 114 and 124 respectfully. The circuits 110 and 120 are configured so that the gaps between poles N and S in the first and second magnetic circuits 110 and 120 are equal in magnitude, but reversed in polarity.

The magnetic source 132 for circuit 130 also can be either a static or a variable source. For purposes of initial explanation, it will be assumed that magnetic source 132 is non-static and creates a variable and fluctuating magnetic field that is created by a coil within magnetic source 132, which coil is excited by an alternating electrical current. The magnetic circuit 130 extends through ferromagnetic conductive structures 134 on opposite end portions of source 132. Opposite ends of the magnetic structure 134 terminate at facing planar ends that are located proximal to but outside of the gaps 138, 138' formed in the first and second magnetic circuits. The dipole 136 is thus longitudinally aligned with the opposite facing end surfaces of the magnetic circuit 134, and is further positioned with its opposite longitudinal ends disposed adjacent the gaps 138, 139 formed by magnetic circuits 110 and 120 respectively. With this arrangement, there is a predetermined (and equal) gap between each of the longitudinal ends of the dipole 136 and one of the opposite facing ends of the magnetic structure 134. As noted above, the dipole 136 is affixed to and supported by the flexible compliant support structure 140.

Magnetic sources 112 and 122 are configured to create magnetic field of flux lines that loop through the emergent high permeable material 114 and 124 respectfully, extending across a first and second fluid (such as air) gaps between the stationary high permeable material of magnetic structure 114 and 116 respectively, progressing through the air gaps 138, 138' and returning on the opposite legs of the structures 114 and 116.

When the current flows in one direction through the coil within magnetic source 132, the resulting magnetic flux causes poles of opposite polarity at the opposite longitudinal ends of the dipole or armature 136, namely, a first pole formed at the first air gap (between one facing end of the magnetic structure 134 and one longitudinal end of armature 136), and a second pole at a second air gap (between the opposite longitudinal end of the armature 136 and the opposite face of magnetic structure 134). Magnetic flux thus extends across the gaps at opposite ends of the dipole 136, and the dipole 136 becomes a component of the magnetic circuit 130. These opposite poles of the dipole 136, so induced in simultaneity by a current within a coil associated with magnetic source 132, are themselves configured, as noted above, to be positioned between the first and second magnetic poles of the static magnetic structures 114 and 124. The direction of the magnetic flux created by the third circuit 130 is perpendicular to the direction of flux created by magnetic circuits 114 and 124. Because the first and second air gaps of the static magnetic structures are reversed in polarity with respect to each other, and because the ends of the dipole or armature 136 are likewise reversed in polarity with respect to each other, there is a net parallel magnetic force applied to the dipole or armature 136 in response to the magnetic flux induced by the current flowing in the coil. As the current in the coil is caused to alternate between plus and minus polarity, the resulting force on the dipole or armature 136 will also alternate upwardly and downwardly with respect to the longitudinal direction of the dipole or armature 136 with a magnitude proportional to the strength of the magnetic poles, causing the dipole 136 to become a moving member. As the dipole armature 136 is reciprocally moved in response to the alternating current applied to the coil with magnetic source 132, the compliant support surface 140 to which it is affixed also moves in a reciprocating manner to facilitate a reciprocating mechanical output from the transducer. If used in the context of an audio speaker, the complaint support surface 140 can be used to move an air column to create sound waves.

Figure 2:
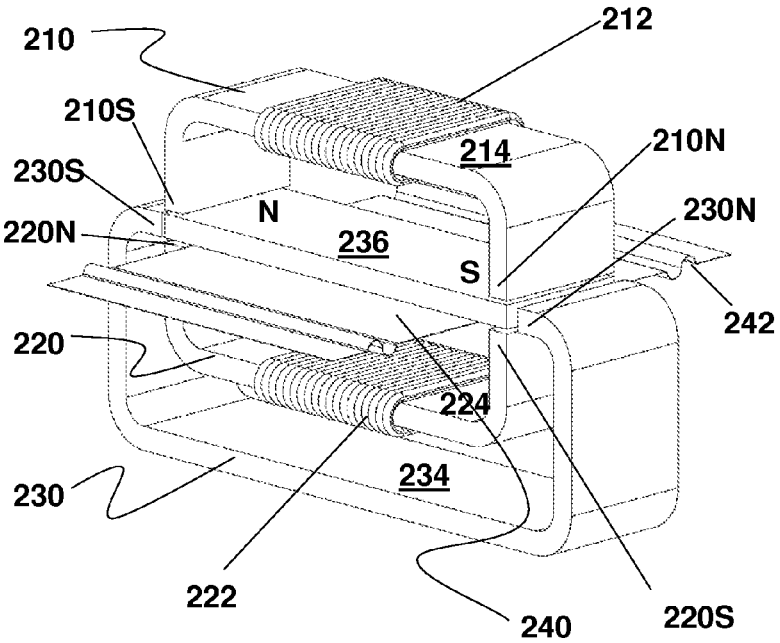
FIG. 2 is a depiction of an alternative configuration of a transducer having a moving member that is structurally decoupled from the physical restraints of the remaining portions of a magnet of which it is a part, but which employs a different arrangement of magnetic circuits from the arrangement depicted in FIG. 1.

FIG. 2 is a schematic depiction of an alternative embodiment of the present invention. Like the embodiment of FIG. 1, this embodiment employs three magnetic circuits, 210, 220, and 230, and a non-magnetic, and selectively compliant armature support structure 240. As a comparison between this embodiment and the embodiment depicted in FIG. 1 shows, the principles of the invention can be utilized with different arrangements of static and non-static magnetic circuits. In other words, multiple arrangements of static and dynamic magnetic circuitry can be employed and the dynamic balancing of the magnetic features with the mass and compliant aspects of the remaining structure can be varied by adjusting a number of easily controlled variables.

As depicted in FIG. 2, magnetic circuit 230 is a static magnetic circuit including a permanent magnet or dipole 236 having ends N and S respectively. In other words, the magnetic source for the circuit is intrinsic to the material forming the dipole 236. Like the embodiment depicted in FIG. 1, the magnet (or magnetic dipole) 236 illustrated in FIG. 2 has a rectangular parallelepiped geometry. Specifically, the magnet 236 has a thickness dimension that is smaller than its width dimension with both the thickness and width dimensions being smaller than its longitudinal length dimension as depicted in the figure. The remainder of the circuit, beginning with the "S" end of permanent magnet 236, comprises an air gap (not numbered) across from which is a north pole 230N of static magnetic circuit 230, which is contiguous with a magnetically permeable structure 234. This portion of the magnetic circuit 230 terminates at magnetic pole 230S, which is contiguous with a second air gap (again not numbered) formed between magnetic pole 230S and the "N" pole of permanent magnet dipole 236, thus completing magnetic circuit 230. Permanent magnet dipole 236 is securely affixed to a directionally selective compliant support structure 240 (in the form of a diaphragm in the illustration) such that movement of permanent magnet dipole 236 is highly constrained in the direction of the air gaps at its longitudinal ends and throughout the plane defined by its width and length. Selective limited movement of the permanent magnet dipole 236 is permitted in its thickness direction (the direction which is orthogonal to the two directions defining the width and length). In other words, the support surface 240 is controllably movable in one of two orthogonal directions that are normal to the longitudinal direction of the magnetically permeable material, but restrained against movement in the longitudinal and other orthogonal directions.

Movement of the magnetic dipole 236 is further enabled by a compliance feature in the form of a foldable surround 242 located at the outer periphery of the support structure 240. In other words, the described configuration depicted in FIG. 2 of the permanent magnet dipole 236 forms a reciprocally moving component of the magnetic circuit 230 and the support structure 240 produces a reciprocally movable mechanical output. As in the case of FIG. 1, the fixed supports of a housing which supports and maintains the spatial relationship between the illustrated structure has been omitted in FIG. 2 for purposes of clarity in schematically illustrating the structures that define the balance of forces in this dynamic balanced floating armature embodiment.

Magnetic partial circuits 210 and 220 are mirror images of one another, comprising equivalent elements and providing a dynamic magnetic circuit responsive to excitation by an electrical signal. The partial circuit 210 specifically comprises a magnetically permeable core 214 about which is wound a current carrying insulated electrical wire coil 212. The circuit is configured to terminate on one end as an instantaneously "north" pole, 210N, atop of an air gap between the core 214 and the "S" pole of permanent magnet dipole 236 and terminates on its other end as an instantaneously created "south" pole, 210S, atop of air gap between core 214 and the "N" pole of permanent magnet dipole 236. Similarly, the partial circuit 220 specifically comprises a magnetically permeable core 224 about which is wound a current carrying insulated electrical wire coil 222. This partial magnetic circuit terminates on one end as an instantaneously "south" pole, 220N, below an air gap between core 224 and the "N" pole of permanent magnet dipole 226 and terminating on its other end as an instantaneously "north" pole, 220N above an air gap between core 224 and the "S" pole of permanent magnet dipole 236. The combined direction of winding and current flows in coil 212 and coil 222 is such as to consistently produce poles of equal and opposite magnetic strength at the respective ends of magnetic partial circuits 210 and 220.

The embodiment depicted in FIG. 2 is operated by presenting an electric current representative of a desired signal to coils 212 and 222 to cause a dynamic magnetic field in the air gap having the "S" end of permanent magnet dipole 236 at one of the ends of the partial circuits 210 and 220 and an equal and opposite dynamic magnetic field in the air gaps above and below the "N" end of permanent magnet dipole 236. The net effect of these equal and opposite magnetic dynamic fields upon the equal and opposite polarity ends of permanent magnet dipole 236 is to create a disturbing force proportional to the applied current in the respective coils, the net forces acting at the "N" and "S" act to displace the armature formed of permanent magnet dipole 236 and the armature support structure 240 in the same direction; i.e. to non-rotationally displace the armature or dipole 236 either up or down. Completing the forces acting on the so-balanced dynamic magnetic forces are the force caused by the mass of the permanent magnet dipole 236 and the (nearly negligible) mass of the non-magnetic support structure 240 as well as the elastic or spring forces provided in the non-magnetic support structure 240. This elastic or spring force is further influenced by such geometric compliance altering features as the compliant support feature 242 between the support structure and its own fixed support (not shown in FIG. 2). The totality of such force balances between those achieved magnetically and those determined by moving masses and springs is such that the magnetic force balance is relatively independent of the spring and mass forces inherent in the moving structures. This provides for an almost infinite choice of mass and spring values for achieving the primary resonance which characterizes the fundamental dynamic behavior of the floating balanced armature motor.

In the particular embodiment shown in FIG. 2, static magnetic forces act longitudinally upon the ends of the armature or dipole 236, i.e. those aligned in the direction of longest dimension of the parallelepiped shown as and example in FIG. 2. These longitudinally acting magnetic forces function in a manner analogous to tensioning forces on the ends of a string, and tend to keep the moving member or armature aligned. The dynamic magnetic force balance, on the other hand, serves to displace the armature upward or downward, again analogous to plucking a tensioned string. However, and unlike the analogous string (where the string's mass, compliance and longitudinal tension create a dominant resonance frequency), the compliance specific to the magnetic dipole 236 element itself, is not the primary contributory compliance acting in the dynamics of the armature system. Instead, the actual compliance (which affects the "spectral signature" of the armature) is dominated by that of the air gaps at the ends of magnetic dipole 236 as assisted by the compliance of support 240 and its compliance influencing feature(s) 242. As such, the dynamic behavior of the armature (containing magnetic dipole 236) is determined nearly entirely by the applied transverse excitational magnetic force balance and, for all practical purposes, independently of any resonance caused by any of the (hard) structures which carry the magnetic flux.

Figure 3:
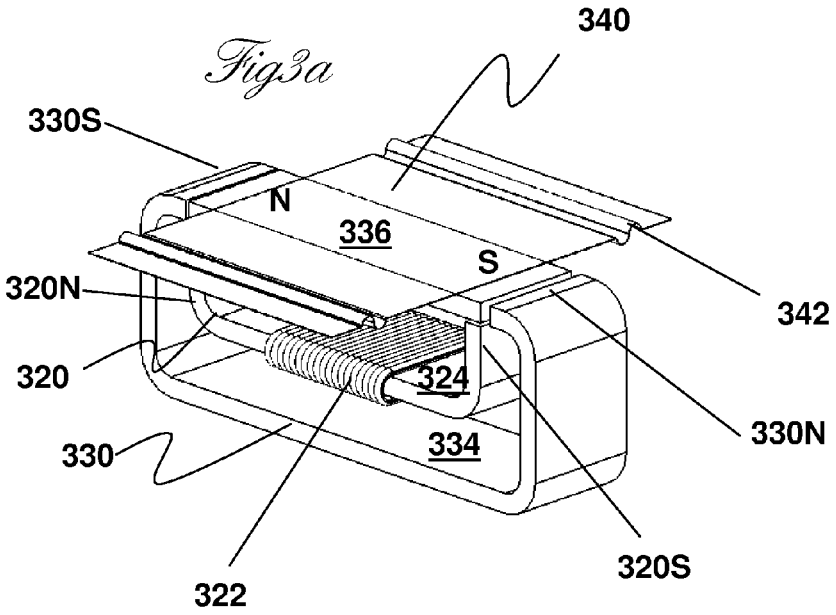
FIG. 3*a* is a depiction of a further alternative configuration of a transducer having a moving member that is mechanically decoupled from the other portions a magnetic circuit of which it is a part, but which employs only two magnetic circuits.
FIG. 3*b* is a perspective view of the moving member or dipole shown in FIG. 3.
FIG. 3*c* is a perspective view of an alternative configuration of the moving member or dipole depicted in FIG. 3*a* having a composite structure.
Figure 3:
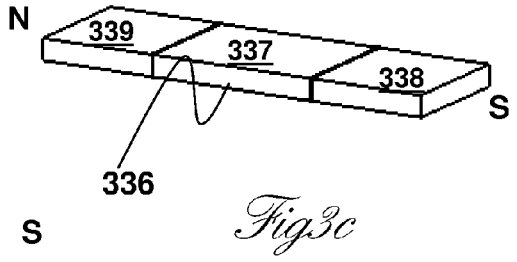
Figure 3:
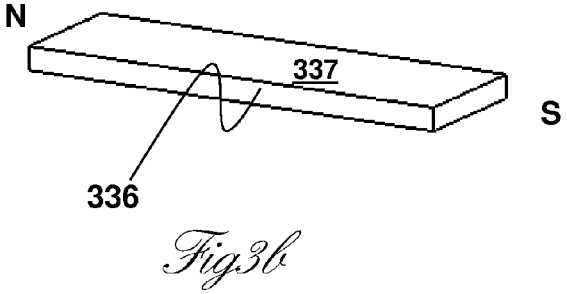

FIG. 3 shows a further example of the present invention illustrating additional ways for varying the static and dynamic details of the magnetic circuitry and additional ways for dynamic balancing of the magnetic features with the mass and compliant aspects of the structure. As shown in this drawing figure, a static magnetic circuit 330 includes a composite dipole 336 having ends N and S respectively. The illustrated composite magnetic dipole 336 of this example has geometry similar to that of the previously described examples, i.e., a rectangular parallelepiped having a thickness dimension that is smaller than its width dimension and both of which are smaller than its length dimension. The magnetic circuit 330 extends from a planar end face on the "S" end of permanent magnet 336 across an air (or other fluid) gap (not numbered) to an opposing (but separated) planar face at the N pole 330N of permeable structure 334, which forms a further component of magnetic circuit 330. The structure 334 extends to magnetic pole 330S which is contiguous with a second air gap (again not numbered) formed between magnetic pole 330S and the "N" pole of permanent magnet dipole 336. Thus, the dipole 336 is a movable member that cooperates with the structure 334 and completes the magnetic circuit 330.

Composite dipole 336 is securely affixed to compliant support structure 340 such that movement of the dipole 336 is highly constrained in the direction of the air gaps and in the plane of the width and length of the dipole 336. The support structure 340 (again, specifically illustrated as a diaphragm) permits movement in the thickness direction of dipole 336, however. Movement in the direction of the thickness direction is facilitated by a compliance feature 342 of the armature support structure 340 in the form of a foldable surround. The configuration shown in this example thus forms a moveable armature in manner similar to the previously described examples. As those skilled in the art will appreciate, a housing supporting the illustrated structure has once again been omitted in the drawing of FIG. 3 to more clearly illustrate the components described above.

The dipole 336 shown in FIG. 3 (as well as the dipole shown in other illustrated embodiments herein) can take a variety of forms. In FIG. 3*a*, the dipole 336*a* is itself both a permanent magnet and a permeable material carrying magnetic flux to the N and S ends respectively of composite dipole 336 facing the fluid gaps present at each such end. In FIG. 3*b*, the dipole 336 comprises a permanent magnetic source 337 and contiguous extensions (without a gap) 338 and 339 as permeable material carrying magnetic flux to the N and S ends respectively of composite dipole 336 facing the fluid gaps present at each such end.

The magnetic circuit 320 in FIG. 3 is a dynamic magnetic circuit responsive to excitation by an electrical signal. This magnetic circuit 320 includes a magnetically permeable core 324 about which is wound a current carrying insulated electrical wire coil 322 and terminating on one end as 320N an instantaneously "north" pole a top of an air gap between itself and the "S" pole of composite dipole 236 and terminating on its other end as 320S beneath of air gap between itself and the "N" pole of composite dipole 336. The combined direction of winding and current flows in coil 322 is such as to consistently produce poles of varying but equal and opposite magnetic strength at the respective ends of magnetic circuit 320.

In operation, an electric current representative of a desired signal is presented to coil 322 to cause a dynamic magnetic field in the air gap having the "S" end of composite dipole 336 at one of the ends of the partial circuit 320 below the "N" end of composite dipole 236. The net effect of these equal and opposite magnetic dynamic fields upon the equal and opposite polarity ends of permanent magnet dipole 336 is to create a disturbing force proportional to the applied current in the coil 322, the net forces acting at the "N" and "S" ends acting to displace the armature formed of composite dipole 336 and the armature support structure 340 in the same direction; i.e. to non-rotationally displace the armature either up or down.

Completing the forces acting on the so-balanced dynamic magnetic forces are the force caused by the mass of the composite dipole 336 and the (nearly negligible) mass of the non-magnetic armature support 340 as well as the elastic or spring forces provided in the non-magnetic support structure 340 as further influenced by such geometric compliance altering features as the compliant support feature 342 between the support structure and its own fixed support (not shown). The totality of such force balances between those achieved magnetically and those determined by moving masses and springs is such that the magnetic force balance is relatively independent of the spring and mass forces inherent in the moving structures.

As with the previously described examples, this embodiment provides for an almost infinite choice of mass and spring values for achieving the primary resonance which characterizes the fundamental dynamic behavior of the floating balanced armature motor. Furthermore, the balance of the various magnetic forces on the armature is totally independent of the compliance and mass of the composite dipole 336. Its balance is almost totally influenced by the strength of the permanent magnet source 337 of the composite dipole 336, the permeability of the dipole ends 338 and 339 (which may or may not be in identity with the permeability or mass of the magnetic source 337 itself). In the particular embodiment shown, the static magnetic forces acting upon the ends of the armature, i.e. those aligned in the long direction of the composite dipole 336, serve analogously as tensioning forces on the ends of a string, tending to keep the armature aligned. The dynamic magnetic force balance, on the other hand, serves to displace the armature upward or downward, again analogous to plucking a tensioned string. However, like the other exemplary embodiments illustrated here, and unlike the analogous string (or traditional "balanced armature" motors and their related acoustic speakers), the dynamic behavior of the illustrated armature 336 is essentially independent of resonance from the hard or rigid magnetically permeable structures forming the magnetic circuits.

FIGS. 4 and 5 depict a further example of a transducer utilizing aspects of the present invention. The example shown in FIGS. 4 and 5 generally utilizes the arrangement of three magnetic circuits which were shown schematically in FIG. 1, but the example illustrated in FIGS. 4 and 5 further shows a housing 502 for supporting the other operative components of the transducer and maintaining appropriate spatial relationships between the components. As shown, the various circuit components of the transducer are maintained in lower housing 502, which lower housing 502 includes a plurality of internal configurations 506 for supporting and positioning the components. The lower housing cooperates with an upper housing 508 to enclose the various other components of the transducer. Upper housing 508 includes a grill 509 which includes a plurality of openings to facilitate the release of sound waves.

Like the other arrangements disclosed herein, the example in FIGS. 4 and 5 utilizes a dipole or armature secured to a support surface that functions as a component of one of a plurality of magnetic circuits. The specifically illustrated dipole or armature 536 shown in FIGS. 4 and 5 is secured to a membrane support 540 which positions the dipole 536 with its opposite longitudinal ends positioned in gaps between magnetic poles (again represented by the letters "N" and "S" indicating north and south poles respectively) of magnetic circuits 510 and 520 respectfully. As illustrated, the armature or dipole 536 forms a component of magnetic circuit 530. The opposite longitudinal ends of the dipole 536 also interact with adjacent components of circuit 530 across fluid gaps (such as air gaps).

As shown, the first magnetic circuit 510 includes a magnetic source 512 which is depicted intermediate legs 514 which extend out of opposite sides of the source 512 and which jointly form a "C" shaped configuration with opposite magnetic poles N and S that are separated by a fluid gap 538. A second magnetic circuit 524 is supported by the housing in generally parallel relationship to the magnetic circuit 512. The circuit 520 similarly has an intermediately disposed magnetic source 522 located between legs 524 which emerge from opposite sides of the magnetic source 522 and jointly form a "C" shaped configuration similar to the magnetic circuit 510. The N and S poles of circuit 520 are reversed with respect to the poles on magnetic circuit 510 and are separated by a fluid gap 538'. Thus configured, the magnetic circuits 510 and 520 produce magnetic flux fields across the fluid gaps 538 and 538' that are generally parallel to each other but have opposite directions.

The magnetic circuit 530 is illustrated as having a magnetic source 532 that is intermediate a pair of magnetically permeable arms 534 and 534'. The arms 534 and 534' respectively terminate in faces that are adjacent to, but spaced from the opposite longitudinal ends of the dipole 536, at locations that are immediately outside of the gaps 538 and 538' formed by magnetic circuits 510 and 520. With this arrangement, the arms 534 and 534' have planar end surfaces that are in face-to-face relationship to end surfaces at the opposite longitudinal ends of dipole 536 but separated therefrom by air gaps. The circuit 530 is configured so that the end surfaces of arms 534 and 534' form magnetic poles of opposite but equal polarity. These magnetic poles communicate through magnetic flux fields focused in the gaps between the opposite longitudinal ends of the dipole 536 and the arms 534 and 534', and are operative to induce poles of opposite polarity on the longitudinal ends of the dipole 536.

Those skilled in the art will appreciate that different combinations of static and non-static sources could be used in the configuration illustrated in FIGS. 4 and 5. As in the explanation of FIG. 1, however, it will be assumed for purposes of illustration that sources 512 and 522 are static, and that source 532 varying in response to an alternating AC signal.

With the opposite longitudinal ends of dipole 536 having opposite induced polarities, and the magnetic structures across gaps 538 and 538' having opposite polarities, and the direction of the magnetic flux created by the circuit 530 being generally perpendicular to the direction of flux created by magnetic circuits 510 and 520, there is a net parallel force and non-rotational force applied to the dipole 536. This net force magnetically urges the dipole 536 either upwardly or downward, toward and away from the N and S poles at the ends of the magnetically permeable legs 514 and 524. As the current in source 532 is caused to alternate between positive and negative polarities, the resulting force on dipole 532 also will alternate with respect to the longitudinal direction of the dipole 536, and the support surface or membrane 540 is reciprocally moved to provide a mechanical output.

Figure 6:
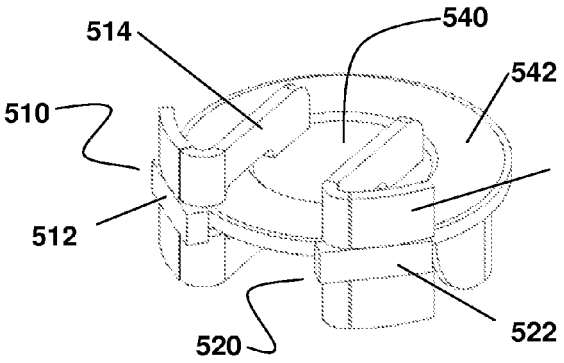
FIG. 6 is an enlarged perspective view of portions of the transducer shown in FIG. 5 depicting the relationship of the support member and two magnetic circuits.
Figure 7:
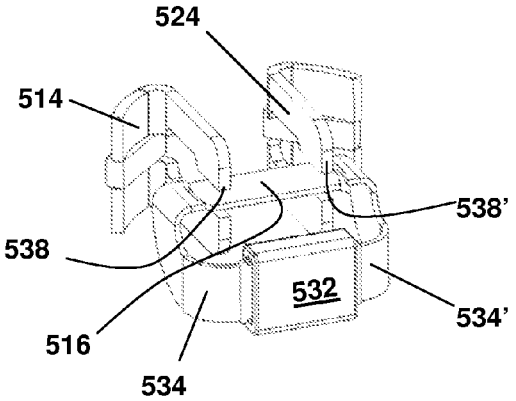
FIG. 7 is an enlarged perspective view showing the relative positional relationship between three magnetic circuits used in one example of the invention.

FIGS. 6 and 7 isolate various components of the magnetic circuits 510, 520 and 530 to show the spatial relationships between these circuits, the support surface 540 and the movable dipole 516 that is affixed to the support surface 540 in the example of FIG. 5. FIG. 6 depicts the support member 540 positioned between the gaps 538 and 538' (obscured by the support member 540). The support member 540 is not shown in the illustration of FIG. 7 to more clearly show the spatial relationship between the dipole 516 and the gaps 538, 538' formed by the magnetically permeable structures 514 and 524 of respective magnetic circuits 510 and 520.

FIG. 8 shows a further example for implementing the invention. The example depicted in FIG. 8 is a variant on the configuration shown in FIG. 3. As shown in FIG. 8*a*, the exemplary transducer illustrated in this example is contained a housing 802, which is topped by a cover 808 having a plurality of apertures 809 for the passage of sound waves. The housing contains a magnetic circuit 820 (see FIG. 8*c*) formed of components defined by magnetically permeable structures 824 and 825. The structures 824 and 825 each have a C-shaped configuration and are arranged with their end surfaces in spaced, face-to-face relationship. An annular insert 829 is supported by the housing 802 and positioned intermediate the structures 824 and 825. The annular insert 829 has a pair of opposing radially extending extensions 831 and 833 which terminate in spaced face-to-face end surfaces. These end surfaces define a gap into which a dipole or armature 836 which is located. The armature 836 is affixed to a diaphragm 840, and includes opposite longitudinal end surfaces that are in spaced face-to-face relationship with the opposing end surfaces of the extensions 831 and 833 across predetermined gaps therebetween. The annular insert 829 (including extensions 831 and 833) also is formed of magnetically permeable material, and this magnetically permeable material becomes a component of a magnetic circuit that extends longitudinally through the armature 836, through the insert extension 831 and insert 829, around the housing 802, back through the insert extension 833 and insert 829 to the gap separating the longitudinal end of the armature 836 and the extension 833.

The circuit 820 includes a coil wrapped around structure 824 that carries a variable AC signal. Similar to the configuration described in FIG. 3, the polarities of the magnetic poles at the longitudinal ends of armature 836 are reversed in plurality as the applied electrical to the coil 822 varies from positive to negative. This, in turn, magnetically urges the armature in reciprocal non-rotational movement upwardly and downwardly in the space between the opposing ends of magnetic structures 824 and 825 with a force proportional to the applied excitation current in coil 822. As in the previously described embodiments, the support member 840 is selectively compliant, and insures that movement of the armature 836 occurs only in a single direction, perpendicular to the plane defined by the support member's surface.

Unlike the circuit disclosed in FIG. 3, the circuit depicted in FIG. 8 includes a magnetically permeable structure 825 which is generally configured as a mirror image of the magnetic circuit component 824. As those skilled in the art will appreciate, the above-described structures facilitate focusing of the magnetic flux by directing that flux between planar surfaces that are arranged in face-to-face relationships. The magnetically permeable structure 825 shown in FIG. 8 also has end surfaces that are in opposing face-to-face relationships with the planar end surfaces on structure 824. This structure 825 further focuses and shapes the magnetic flux emanating from the ends of structure 824, thereby preventing magnetic scattering and increasing the intensity of the flux in the gap adjacent to the ends of structure 824. As shown, the magnetically permeable structure 825 further includes a plurality of apertures to facilitate sound wave transmission from the moving support member 840 and through apertures 809 to the ambient environment.

The foregoing description of the preferred embodiments of the present invention have been presented for purposes of illustration and description. It is not intended to be exhaustive or to limit the invention to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. All such embodiments and variations are within the scope of the invention as determined by the appended claims when interpreted in accordance with the breadth to which they are fairly, legally, and equitably entitled. The drawings and preferred embodiments do not and are not intended to limited the ordinary meaning of the claims in their fair and broad interpretation in any way.

What is claimed is:

1. An electro-magnetic transducer, comprising:

a. a housing;

b. a plurality of magnetic circuits supported by the housing, one or more of the plurality of magnetic circuits forming end surfaces at predetermined spaced locations within the housing, the end surfaces or the one or more magnetic circuits being operative to emanate magnetic flux densities of equal and opposite polarities at the predetermined spaced locations;

c. a further magnetic circuit, the further magnetic circuit being structurally configured so that components of the further magnetic circuit terminate with their respective ends facing one another across a predetermined expanse with a movable dipole of magnetically permeable material residing in the predetermined expanse, the dipole having its opposite longitudinal ends in spaced relationship to the respective facing ends of the circuit components so as to form two gaps, one at each end of the dipole, the dipole being configured and positioned so that its opposite ends reside in proximity to the predetermined spaced locations in magnetic flux of equal and opposite polarities emanating at the end surfaces of the one or more magnetic surfaces; and d. a non-magnetic permeable support member affixed to and supporting the dipole, said support member providing selective positional compliance so that its support of the dipole is compliant in the direction generally perpendicular to the plane of the support surface and generally non-compliant within such plane, at least one of the plurality of magnetic circuits being non-static and operative to vary the magnetic flux in the proximity of the predetermined spaces, the dipole being operative to move under the influence of the interaction of the magnetic fluxes at the predetermined spaced locations in response to a changes in the magnetic flux created by at least one of the magnetic circuits.

2. An electro-magnetic transducer as recited in claim 1 wherein the housing functions to support the plurality of magnetic circuits in a predetermined spatial relationship to each other.

3. An electro-magnetic transducer as recited in claim 1 wherein the housing supports the selectively positionally compliant support member affixed to the dipole in a plane normal to the primary direction of the magnetic flux emanating from the end surfaces.

4. An electro-magnetic transducer as recited in claim 1 wherein the housing retains the non-magnetically permeable support member in a predefined spatial relationship to the magnetic flux emanating from the end surfaces.

5. An electro-magnetic transducer as recited in claim 1 wherein the non-magnetically permeable support member is a diaphragm.

6. An electro-magnetic transducer as recited in claim 1 wherein the housing supports the diaphragm at the diaphragm's peripheral surface.

7. An electro-magnetic transducer as recited in claim 1 wherein the diaphragm has a circular configuration, and the housing supports the diaphragm around the circular peripheral surface of the diaphragm.

8. An electro-magnetic transducer as recited in claim 1 wherein the opposite longitudinal ends of the dipole are positioned in high density portion of magnetic flux emanating from the end surfaces of one or more of the plurality of magnetic circuits 9. An electro-magnetic transducer as recited in claim 1 wherein the end surfaces of the one or more of the plurality of magnetic circuits are configured to focus the magnetic flux density at opposite longitudinal ends of the dipole.

10. An electro-magnetic transducer as recited in claim 1 wherein the positional compliance provided by the non-magnetically permeable support member in the direction generally perpendicular to the plane of the support surface is non-linear.

11. An electro-magnetic transducer as recited in claim 1 wherein the positional compliance provided by the support member in a direction generally perpendicular to the plane of the support surface is inversely proportional to magnetic strength of the magnetic poles.

12. An electro-magnetic transducer as recited in claim 1 wherein the one or more of the plurality of magnetic forming the end surfaces is a rigid structure.

13. An electro-magnetic transducer as recited in claim 1 wherein the one or more of the plurality of magnetic circuits includes at least two magnetic circuits that are rigid structures and are mirror images of each other, and are configured to approach each other as they approach the end surfaces.

14. An electro-magnetic transducer as recited in claim 1 wherein the plurality of magnetic circuits are formed of a magnetically permeable material.

15. An electro-magnetic transducer as recited in claim 1 wherein the magnetically permeable material is formed from a rare earth metal.

16. An electro-magnetic transducer as recited in claim 1 wherein the magnetically permeable material is formed of a ferromagnetic material.

17. An electro-magnetic transducer as recited in claim 1 wherein at least one of the plurality of magnetic circuits is a static magnetic circuit.

18. An electro-magnetic transducer as recited in claim 1 wherein at least one of the plurality of magnetic circuits includes a permanent magnet.

19. An electro-magnetic transducer as recited in claim 1 wherein the one or more of the plurality magnetic includes at least one static magnetic source and at least one dynamic magnetic source.

20. An electro-magnetic transducer as recited in claim 1 wherein the magnetic sources include at least one permanent magnet and the least one electromagnet.

21. An electro-magnetic transducer as recited in claim 1 wherein magnetic source for the third magnetic circuit is a dynamic magnetic source.

22. An electro-magnetic transducer as recited in claim 1 wherein the non-magnetic support member includes a compliance defining structure on its periphery.

23. An electro-magnetic transducer as recited in claim 1 wherein the non-magnetic support member includes a surround about its periphery.

24. An electro-magnetic transducer as recited in claim 1 wherein the electro-magnetic transducer is configured as a speaker.

25. An electro-magnetic transducer as recited in claim 1 wherein the non-magnetic support surface is a diaphragm and housing supports a grid in juxtaposition to the diaphragm, the grid providing a plurality of openings between the diaphragm and the environment outside of the housing.

26. An electro-magnetic transducer as recited in claim 1 wherein at least one of the plurality of magnetic circuits is dynamically responsive to an external signal.

27. An electro-magnetic transducer as recited in claim 1 wherein at least one of the magnetic fields is static.

28. An electro-magnetic transducer as recited in claim 1 wherein the transducer includes one dynamic magnetic field, and to static magnetic fields that are equal and opposite to each other.

29. An electro-magnetic transducer, comprising:

a. a housing;

b. a first magnetic circuit including:

i. a magnetic dipole, the magnetic dipole extending between first and second longitudinally spaced magnetic poles; and ii. one or more magnetic circuit components formed of magnetically permeable material, the one or more magnetic circuit components having first and second ends that are located in predetermined longitudinally spaced proximity to the first and second magnetic poles of the dipole respectively, and separated from the first and second magnetic poles of the magnetic dipole by fluid gaps, the one or more magnetic circuit components being magnetically connected to the magnetic dipole across the fluid gaps, the dipole and the at least one or more magnetic circuit components providing a contiguous magnetic pathway;

c. a support surface supported with respect to the housing, the magnetic dipole being affixed to the support surface, the support surface and the attached magnetic dipole being controllably movable through a limited range of movement in a first direction that is substantially perpendicular to the support surface, the support surface being further operative to restrain movement of the magnetic dipole in the other two directions orthogonal to said first direction and to each other; and d. one or more further magnetic circuits existing between first and second areas in proximity to the respective first and second magnetic poles of the magnetic dipole and interacting with the magnetic dipole, the one or more further magnetic circuits having first and second end surfaces that are respectively located in respective first and second areas in predetermined spaced proximity to the first and second magnetic poles of the magnetic dipole and separated from the respective first and second magnetic poles by predetermined fluid gaps, the one or more further magnetic circuits being magnetically connectable to the magnetic dipole by magnetic flux that traverses the predetermined fluid gaps separating the magnetic dipole and the one or more further magnetic circuit components;

e. at least one magnetic source for applying a varying magnetic flux in the area occupied by the magnetic poles of the magnetic dipole that is operative to move the support member and affixed magnetic dipole back and forth through the limited range of movement in the first direction.

30. An electro-magnetic transducer as recited in claim 29 wherein the magnetic dipole is a permanent magnet.

31. An electro-magnetic transducer as recited in claim 30 wherein the permanent magnet is formed of a rare earth material.

32. An electro-magnetic transducer as recited in claim 31 wherein the permanent magnet is formed from a material from the group of neodymium, boron and iron.

33. An electro-magnetic transducer as recited in claim 31 where the permanent magnet is formed of samarium cobalt.

34. An electro-magnetic transducer as recited in claim 29 wherein the support surface is a diaphragm.

35. An electro-magnetic transducer as recited in claim 30 wherein the diaphragm is operative to move a fluid confined by the housing and the surface of the diaphragm.

36. An electro-magnetic transducer as recited in claim 29 wherein the magnetic dipole is formed of magnetically permeable material.

37. An electro-a medic transducer as recited in claim 29 wherein the first and second end surfaces of the one or more further magnetic circuits includes are spaced from the first and second magnetic poles of the magnetic dipole in the first direction.

38. An electro-magnetic transducer as recited in claim 29 wherein the first and second ends of the one or more magnetic circuit components exert a longitudinally directed magnetic force on the opposite ends of the magnetic dipole.

39. An electro-magnetic transducer as recited in claim 32 wherein the magnetic source for applying a varying magnetic flux includes a coil circumferentially disposed about the one or more further magnetic circuits.

40. An electro-magnetic transducer as recited in claim 29 wherein there are at least three magnetic pathways extending from one longitudinal end of the magnetic dipole to the other.

41. An electro-magnetic transducer as recited in claim 40 wherein the three magnetic pathways include a pair of magnetic pathways that are mirror images of each other with the magnetic circuits forming the pair being disposed on opposite sides of the magnetic dipole.

42. An electro-magnetic transducer as recited in claim 29 wherein the first magnetic circuit includes a magnetic source formed by a coil circumferentially disposed about the one or more magnetic circuit components.

43. An electro-magnetic transducer as recited in claim 29 wherein the one or more further magnetic circuits includes at least one magnetic circuit having first and second end surfaces separated from the respective first and second magnetic poles of the magnetic dipole by predetermined fluid gaps extending in the first direction.

44. An electro-magnetic transducer as recited in claim 29 wherein the one or more further magnetic circuits includes a pair of magnetic circuits, with each of the circuits forming the pair having first and second end surfaces separated from the respective first and second magnetic poles of the magnetic dipole by predetermined fluid gaps extending in the first direction, and wherein the circuits forming the pair are on opposite sides of the magnetic dipole.

45. An electro-magnetic transducer as recited in claim 29 wherein the magnetic poles of the magnetic dipole are induced by magnetic flux emanating from the first and second ends of the one or more magnetic circuit components.

46. An electro-magnetic transducer as recited in claim 45 wherein the at least one magnetic source for applying magnetic flux applies a varying magnetic flux to the one or more further magnetic circuits.

47. An electro-magnetic transducer as recited in claim 45 wherein the at least one magnetic source includes a coil disposed about the magnetically permeable material and the one or more further magnetic circuits.

48. An electro-magnetic transducer as recited in claim 29 wherein the one or more magnetic circuit components includes magnetically permeable material that continuously extends between the first and second ends that are longitudinally spaced in proximity to the magnetic poles of the dipole.

49. An electro-magnetic transducer as recited in claim 29 wherein the one or more further magnetic circuits includes a first and second magnetic circuits that are disposed on opposite sides of the magnetic dipole, each of which having first and second ends that are located in the respective first and second areas.

50. An electro-magnetic transducer as recited in claim 49 wherein the one or more further magnetic circuits includes a pair of magnetic circuits on opposite sides of the magnetic dipole, each of the magnetic circuits having first and second and end surfaces that are respectively spaced from the first and second magnetic poles of the magnetic dipole by gaps extending in the first direction.

51. An electro-magnetic transducer as recited in claim 46 wherein the respective first and second magnetic and services of the pair of magnetic circuits have opposite polarity.

* * * * *